US006288491B1

(12) United States Patent
Ramaiah et al.

(10) Patent No.: US 6,288,491 B1
(45) Date of Patent: Sep. 11, 2001

(54) METAL HALIDE LAMP

(75) Inventors: Raghu Ramaiah, Eastlake; Timothy Peter Dever, Fairview Park; Casey Autumn Brown, New Waterford, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/290,008

(22) Filed: Apr. 9, 1999

(51) Int. Cl.[7] ..... H05B 37/02

(52) U.S. Cl. ..... 315/52; 315/53; 315/59; 315/60

(58) Field of Search ..... 315/51, 52, 53, 315/56, 57, 58, 59, 60

(56) References Cited

U.S. PATENT DOCUMENTS 4,173,730 * 11/1979 Young et al. ..... 315/53

* cited by examiner

*Primary Examiner*—David Vu

(74) *Attorney, Agent, or Firm*—Fay, Sharpe, Fagan, Minnich & McKee, LLP

(57) ABSTRACT

To achieve the foregoing objects and in accordance with the purpose of the invention, as embodied and broadly described herein, the metal halide lamp of this invention comprises a vitreous arc tube containing an ionizable medium and having electrodes sealed into opposed ends of the arc tube. An outer envelope encloses the arc tube and includes one end accommodating inleads sealed therethrough. A base is attached to the outer envelope having input terminals, the input terminals being connected to the inleads which in turn are connected to the tungsten electrodes. A mount is provided to support the arc tube within the outer envelope. The ionizable medium will include mercury, a metal halide, and an inert gas selected from the group consisting of argon, krypton, and xenon and mixtures thereof. In addition, a starting circuit having an open circuit voltage of at least 200 volts RMS will be provided. The inert gas having a pressure of at least about 70 torr.

20 Claims, 5 Drawing Sheets

METAL HALIDE LAMP

BACKGROUND OF THE INVENTION

The present invention relates to high pressure arc discharge lamps and is particularly applicable to lamps containing a metal halide fill and employing a tungsten electrode.

High pressure metal halide discharge lamps (MHL) are generally comprised of a fused silica or quartz arc tube containing an ionizable fill and having a pair of main thermionic electrodes at the ends. In most applications the electrodes include a relatively high percentage of tungsten. The electrodes are supported by inleads which include a thin molybdenum ribbon portion extending hermetically through a pinch or press seal in the end of the lamp. The purpose of the ribbon being to prevent seal failures because of thermal expansion of the lead in wire. Generally, a starter electrode is disposed in the arc tube adjacent one of the main electrodes to facilitate starting. In most lamps, a discharge can be ignited between the starter and the adjacent main electrode at a much lower voltage than between the two main electrodes, and ignition of the arc between the main electrodes is thereby facilitated.

Historically, the metal halide lamp has been available as an interchangeable line which will start and operate reliably on many kinds of conventional ballasts, including those used in high pressure mercury vapor lamps. This is a great advantage since it is often desirable to replace mercury lamps and older installations of metal halide lamps with newer metal halides which have a much higher lumen output and better color rendition.

Unfortunately, the maintenance of initial lumens in even the newer MHL lamps is a problem because of highly complex chemical reactions occurring in the atmosphere within the arc discharge chamber. More specifically, at the operating temperature of 5,500° K. at the center of the arc, to approximately 1,100° K. at the wall of the arc tube, which defines a boundary of the plasma, many and various reactions occur. One negative reaction is the transport of metallic and inorganic compounds of tungsten (the main electrode constituent) from the electrode to the walls of the discharge tube during operation of the lamp. The tungsten, in its various compound forms so transported, creates an opaque barrier on the inner wall of the arc tube, thus preventing discharge radiation from being effectively transmitted. In short, significant losses to the level of lumens can occur. This loss of light level from within the discharge is perceived externally as a reduction of light output of the lamp, and thereby reduction in the maintenance of initial lumens. It is believed that the transport of tungsten and tungsten compounds to the walls of the discharge tube occurs through sputtering, evaporation and other chemical mechanisms.

SUMMARY OF THE INVENTION

Accordingly, it is a primary advantage of the present invention to provide a new and improved metal halide lamp.

It is a further advantage of this invention to provide a new and improved metal halide lamp that reduces the rate at which tungsten is lost from the electrodes to the inner walls of the arc discharge tube.

Additional objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the metal halide lamp of this invention comprises an arc tube containing an ionizable medium and having electrodes, preferably tungsten, sealed into opposed ends of the arc tube. An outer envelope encloses the arc tube and includes one end accommodating inleads sealed therethrough. A base is attached to the outer envelope and includes input terminals, the input terminals being connected to the inleads which in turn are connected to the tungsten electrodes. The ionizable medium includes mercury, a metal halide, and an inert gas selected from the group consisting of argon, krypton, xenon and mixtures thereof. Importantly, the inert gas will be at a cold pressure of at least about 50 torr. In addition, a starting circuit having an open circuit voltage of at least 200 volts RMS is provided.

In a preferred form of the invention, the inert gas will be present at a level of about 70 torr and possibly at greater than about 110 torr. In a particularly preferred form of the invention, the inert gas will be argon. Typically, the inventive lamp will operate at between 250 and 1500 watts.

BRIEF DESCRIPTION OF THE DRAWINGS

The invention consists in the novel parts, construction, arrangements, accommodations and improvements shown and described. The accompanying drawings which are incorporated in and constitute a part of the specification illustrate one embodiment of the invention together with the description, serve to explain the principles of the invention. Of the Drawings.

DETAILED DESCRIPTION OF THE INVENTION

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
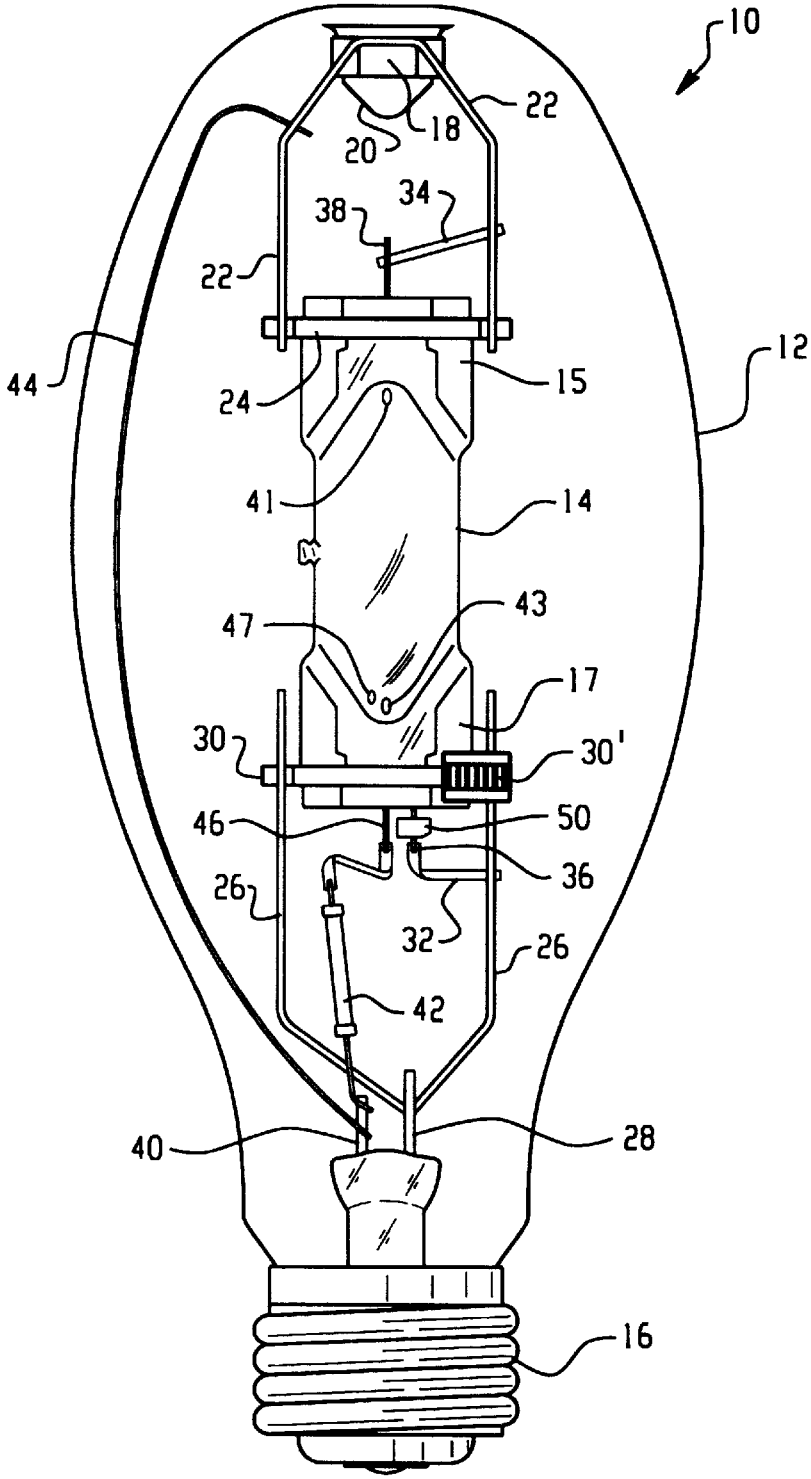
Fig. 1 PRIOR ART
FIG. 1 is front view of a prior art metal halide lamp suitable for adaption to the present invention.

Referring now to FIG. 1, a traditional metal halide lamp is depicted to which the present invention is basically suited. Particularly, it may be seen that lamp 10 is comprised of an outer envelope 12 made of a light transmittent vitreous material, such as glass and a light transmittent arc chamber 14 made of fused silica or fused quartz. Lamp 10 further comprises a base 16 having suitable electrical contacts for making electrical connection to the electrodes and arc chamber 14. Arc chamber 14 is held in place within envelope 12 by frame parts comprising a spring clip metal band 18 surrounding a dimple 20 on envelope 12. Support 22 is spot welded to band 18 and also spot welded to strap member 24. Strap member 24 is securely and mechanically fastened about the pinch seal region 15 of arc chamber 14. The other end of the arc chamber is secured by support member 26 which is spot welded at one end to electrically conductive terminal 28 and welded at the other end of strap member 30. Strap member 30 is securely and mechanically fastened about the second pinch seal region 17 of the arc chamber 14.

Conductive members 32 and 34 are spot welded at one end to support members 26 and 22, respectively, and at the other end to inleads 36 and 38, respectively, of the respective arc chamber 14 electrodes (41 and 43), inlead 36 including bimetallic switch 50. Electrically conductive member 40 is spot welded to resistor 42 and current conductor 44. The other end of resistor 42 is connected to the inlead 46 of a starting electrode (47). Except for conductor 44 and inleads 36, 38 and 46, which are made of molybdenum, and actual resistor portion of resistor 42, all of the frame parts may be made of a nickel plated steel. The lamp also contains a getter strip 30' coated with a metal alloy material to getter or absorb hydrogen from inside the lamp envelope.

The focus of the present invention is to limit the loss of tungsten from the electrodes to the walls of the arc discharge chamber. In this regard, it is stated above that sputtering and evaporation are two of the primary mechanisms for transport of tungsten from the electrodes to the walls of the arc discharge chamber. Sputtering occurs mainly during the initial start of the MHL.

In MHL's, each electrode operates as a cathode and an anode, during one cycle of application in the ballast wave form. In the cathode phase, when the electrode has a negative potential impressed on it by the ballast, the electrode attracts the positive ions present in its immediate neighborhood. These ions are accelerated through a region called the cathode fall, and depending upon the mobility of the ionic species, acquire sufficient kinetic energy in the time during which the electrode is a cathode, to impact the electrode directly. Ion impact on a surface will collisionally transfer energy to the lattice with the result that some lattice atoms may acquire sufficient energy to be ejected or sputtered from the surface. Typically, the sputtered particles have an average energy of a few electron volts, and are ejected with a coefficient ranging from 0.001 (for light ions such as H) to 10 to 20 for (heavy ions such as Pb). This coefficient, defined as the sputtering yield is the number of lattice atoms ejected per incident ion. The ion bombardment that occurs in the initial start of the MHL is primarily due to argon ions.

The sputtered tungsten ions have a fairly large mean free path, because during the conditions of this initial start up, the surrounding gas pressure is low (several torr), and the sputtered tungsten atoms easily make it to the wall of the discharge tube, resulting in a coating of tungsten atoms. More specifically, until the temperature of the arc chamber is increased, much of the fill media is in a condensed form. As the discharge heats up, mercury ions also participate in the sputtering process. When the lamp reaches its operating point, the mercury pressure is in the order of several atmospheres, and the sputtering effect due to ionic bombardment is minimized, due to the reduced mean free path of the sputtered tungsten atoms.

Applicants have found that if the cold gas fill, primarily the inert gas, is increased sufficiently, there is a minimization of the wall blackening on the quartz wall of the discharge tube. It is believed that this occurs because of a reduction in the mean free path of the sputtered tungsten atoms during the initial start up. However, it was found that it is not possible to arbitrarily increase the cold fill of a metal halide lamp and still start reliably on standard metal halide ballasts.

Figure 2:
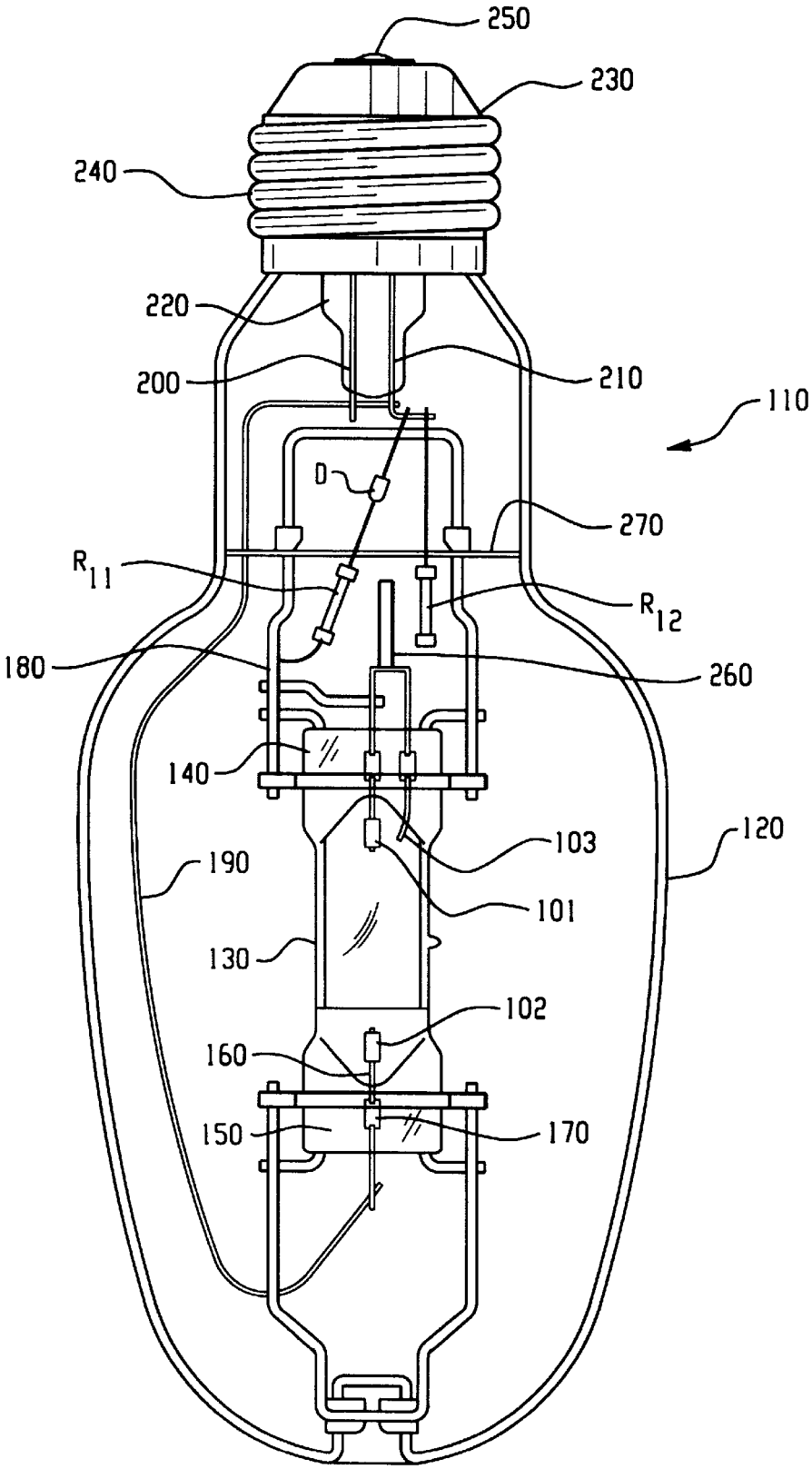
FIG. 2 is a front view of a metal halide lamp equipped with a voltage doubling circuit.

Referring to FIG. 2, a metal halide lamp 110 embodying the invention comprises an outer glass envelope 120 containing a quartz or fused silica arc tube 130 having flat pressed or pinched ends 140, 150. Main electrodes 101, 102 are mounted in opposite ends of the arc tube, each including a shank portion 160 which extends to a molybdenum foil 170 to which an outer current conductor is connected. The distal portions of the main electrode shanks are surrounded by tungsten wire helices. The hermetic seals are made at the molybdenum foils upon which the fused silica of the pinches are pressed during the pinch sealing operation. The auxiliary starting electrode 103 is provided at the upper end of the arc tube close to main electrode 101 and consists merely of the inwardly projecting end of a fine tungsten wire. Main electrodes 101,102 are connected by conductors 180,190 to outer envelope inleads 200, 210 sealed through stem 220 of the outer envelope. The outer envelope inleads are connected to the contact surfaces of screw base 230 attached to the neck end of the envelope, that is to the threaded shell 240 and to the insulated center contact 250.

Arc tube 130 is provided with an ionizable radiation-generating fill in accord with the invention. One suitable filling comprises mercury, sodium iodide, scandium iodide, and at least 50 torr of an inert gas such as argon.

In accordance with the invention, diode D and resistor $R_{11}$ connected in series are bridged across the main electrodes, being connected, the diode to conductor 180 and thereby to inlead 200, and the resistor to inlead 210. When the lamp is inserted into its socket, this places the diode-resistor bridge across the ballast terminals as shown FIG. 3, and the polarity of the diode allows current flow when inlead 200 is positive relative to inlead 210. Resistor $R_{12}$ is connected between starter electrode 103 and inlead 210 so that it is effectively connected between the starter and the remote main electrode. The indicated polarity for the diode is preferred because it results in a positive voltage build-up at unactivated starter electrode 103 and this is more effective for starting because it allows adjacent main electrode 100 to operate as cathode. A thermal switch 260 of the bimetal type is attached to the inlead of main electrode 101 and is arranged to expand and contact the starter electrode inlead after the lamp has warmed up. The thermal switch thus short circuits the starter to the adjacent main electrode after warm-up and this is desirable to prevent electrolysis of the fused silica in the region of the inleads.

In this embodiment, a heat shield 270 constructed of mica or other material known to the skilled artisan is provided between the arc chamber 130 and diode D. Furthermore, diode D is positioned distally from the arc chamber. Each of these features are provided to maintain the diode at as low a temperature as possible. Moreover, the cooler the diode is kept, the longer it will function and provide better clamping for the doubler circuit. Similarly, if the diode becomes too hot, reverse leakage may occur, decreasing the Peak Voltage Multiplier (PVM) of the starting circuit. Additional options to moving the diode closer to the base or the heat shield include (i) locating the diode in the base and (ii) use two diodes in series to decrease reverse leakage.

Typical ballasts provide an open circuit voltage sufficient to start an MHL with 25 to 35 torr argon. However, commercial requirements state that at 10° C. at 0 hours, 98% of lamps must start. In addition, at −30° C. at 100 hours, 90% of lamps must start at −30° C. within 2 minutes. The requirement at −30° C. is especially stringent for MHL's because while at room temperature, there is a residual vapor pressure of mercury which is often sufficient to act with the argon as a penning mixture, at −30° C., the mercury is nearly completely condensed and the MHL lamp starting becomes especially difficult. The present inventors have found that by increasing the cold fill levels (i.e. temperature vapor pressure) to a level of at least about 70 torr, significant benefits in minimizing tungsten loss can be achieved.

Figure 3:
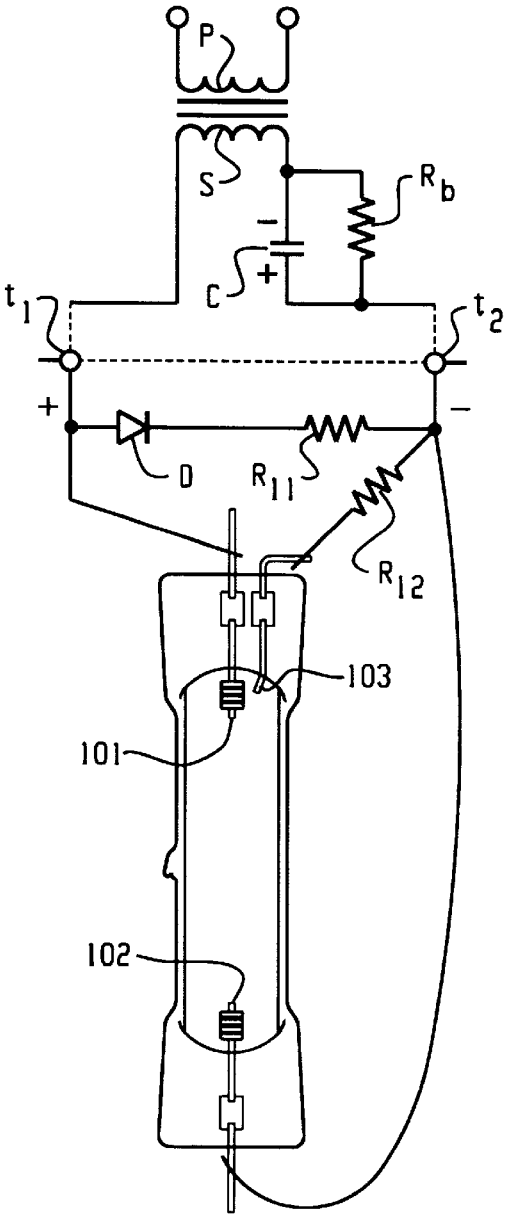
FIG. 3 is a schematic diagram of the starting circuit for the lamp of FIG. 2.

Importantly, the present inventors have also found that by employing a voltage doubling circuit in the lamp (such as shown in FIG. 2), in conjunction with a typically available ballast, an acceptable starting performance is achieved. A preferred starting circuit is shown at FIG. 3. Other exemplary starting circuits suitable for use in the present invention include those described in U.S. Pat. Nos. 4,007,397; 3,900,761; 3,982,154; 4,097,777; 4,258,289; and 4,992,703, the disclosures of which are herein incorporated by reference. Accordingly, the present invention envisions the inclusion of one of these circuits, or in fact, any voltage doubling circuit into the lamp embodiment of FIG. 1.

Figure 5:
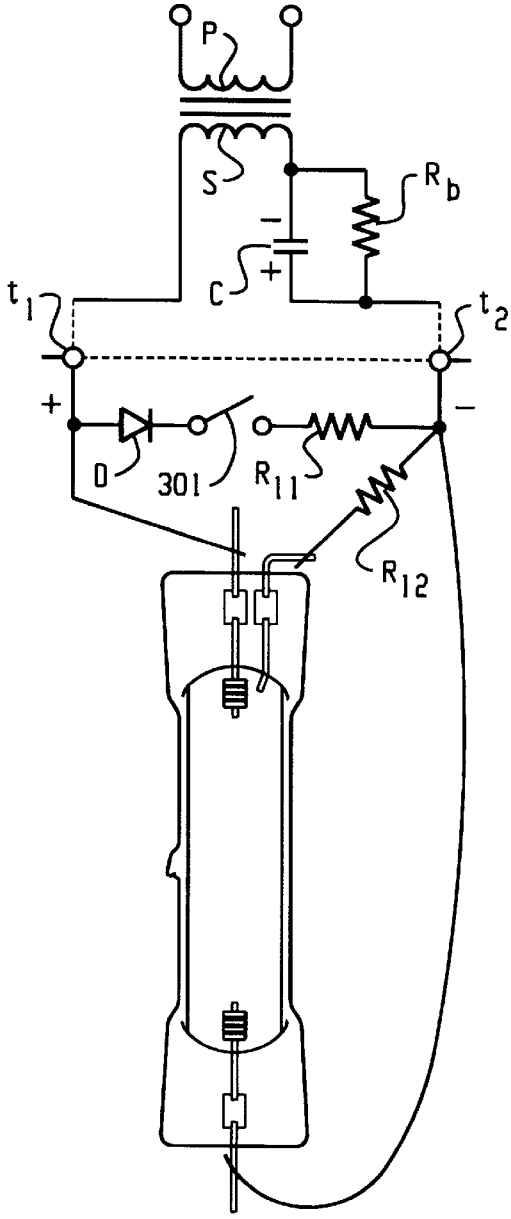
FIG. 5 is a schematic representation of an alternative embodiment of the starting circuit.

In a particularly preferred embodiment, the starting circuit of FIG. 5 is used. In this embodiment, the starting circuit is similar to that of FIG. 3 but includes a bimetal switch 301 which can remove the voltage doubling circuitry once an appropriate lamp operating temperature is achieved. This feature is desirable because the voltage doubling circuitry could affect lamp operation under certain conditions.

Additional preferred embodiments of the invention include variations in the voltage doubling circuit. Particularly, the skilled artisan recognizes that UL requires a resister in the circuitry to minimize the potential for unexpected electric shock after a ballast is disconnected from live current. Unfortunately, the resistor also functions to decrease the peak voltage which can be achieved by the starting circuit.

In this regard, the PVM can range from 1 (no clamping) to 2 (perfect clamping, when the capacitor charges to peak open circuit voltage). The closer the PVM can be made to 2.0, the more efficient the lamp starting. In the example of FIG. 3, the PVM is 1.63. The capacitor resistor, Rb, which is required for safety, limits the PVM value; its presence drains the capacitor. Lowering resistor R11 in FIG. 3 will allow the capacitor to charge to a higher value by allowing more current to flow to the capacitor during the charging cycle; this increases the PVM and thus starting efficiency of the circuit. The table below demonstrates improvements in PVM by decreasing R11 value, in the case of a cold lamp start (resistor values in Kohms);

| Rb | R11 | R12 | PVM |
|---|---|---|---|
| 500 | 20 | 40 | 1.63 |

-continued

| Rb | R11 | R12 | PVM |
|---|---|---|---|
| 500 | 10 | 40 | 1.76 |
| 500 | 7 | 40 | 1.82 |
| 500 | 5 | 40 | 1.85 |

In the case of a hot lamp start, a low impedance path is present between R12 and ground, either by a path through the bimetal 260 (see FIG. 2), or a glow between electrodes 101 and 103. This places R12, plus the low impedance path, across the main electrodes, loading the capacitor and lowering the PVM. Increasing R12 will decrease the load on the capacitor and increase the PVM in a hot restart condition. The table below was generated for the worst case condition of the hot restrike, bimetal closed (resistor values in Kohms):

| Rb | R11 | R12 | PVM |
|---|---|---|---|
| 500 | 20 | 20 | 1.13 |
| 500 | 20 | 40 | 1.21 |
| 500 | 20 | 80 | 1.28 |
| 500 | 20 | 120 | 1.33 |

Accordingly, a desirable starting circuit could include a relatively low R11 and a relatively high R12. Moreover, having R11 less than R12 is preferred and even greater than five times less than R12 is potentially beneficial.

EXAMPLES

The following examples are provided to assist in explaining the invention but are not intended to limit the invention.

Starting

Eight cells of lamps, (A–H), each cell comprised of at least seven individual lamps were evaluated. The lamps were each 400 watt and included as a fill of sodium and scandium iodides, plus mercury. In addition, Cells A and B included a 30 torr argon cold fill; cells C and D a 70 torr argon cold fill; cells E and F a 90 torr argon cold fill; and cells G and H a 110 torr argon cold fill. Cells A, C, E and G were equipped with a voltage doubler of the type 4 097 777; cells B, D, F and H were not fitted with a voltage doubler. Lamp ignition was measured at 10° C. and at −30° C., CTT being measured also. The results of the experimentation are depicted in Table 1.

TABLE 1

| | 33 torr | | | 70 torr | | | 90 torr | | | 110 torr | | |
|---|---|---|---|---|---|---|---|---|---|---|---|---|
| | ID | 10C | −30C | ID | 10C | −30C | ID | 10C | −30C | ID | 10C | −30C |
| With | A1 | 10 | 12 | C1 | 55 | 54 | E2 | 3 | 98 | G1 | 8 | 19 |
| Voltage | A2 | 5 | 0 | C2 | 1 | 93 | E3 | 6 | 16 | G2 | 6 | 5 |

TABLE 1-continued

| | 33 torr | | | 70 torr | | | 90 torr | | | 110 torr | | |
|---|---|---|---|---|---|---|---|---|---|---|---|---|
| | ID | 10C | −30C | ID | 10C | −30C | ID | 10C | −30C | ID | 10C | −30C |
| Double | A3 | 10 | NA | C3 | 15 | 11 | E4 | 58 | 24 | G3 | 11 | 13 |
| | A4 | 3 | 3 | C4 | 12 | 10 | E5 | 15 | 7 | G4 | 8 | 4 |
| | A5 | 2 | 8 | C5 | 30 | 13 | E6 | 3 | 6 | G5 | 56 | 95 |
| | A6 | 2 | NA | C6 | 6 | 0 | E7 | 3 | 43 | G6 | 9 | 54 |
| | A7 | 4 | 14 | C7 | 5 | 4 | E8 | 35 | 13 | G7 | 20 | 28 |
| | A8 | 5 | 7 | C8 | 8 | 21 | E9 | 3 | 43 | G8 | 20 | 17 |
| | A10 | 5 | 26 | C9 | 3 | 12 | | | | G9 | 3 | 16 |
| | | | | C10 | 1 | 32 | | | | | | |
| Without | B1 | 25 | NA | D1 | NS | NS | F1 | NS | NS | H1 | NS | NS |
| Voltage | B2 | 5 | 1 | D2 | NS | NS | F2 | NS | NS | H2 | NS | NS |
| Doubler | B3 | 16 | 14 | D3 | NS | NS | F3 | NS | NS | H3 | NS | NS |
| | B4 | 4 | 26 | D4 | NS | NS | F4 | NS | NS | H4 | NS | NS |
| | B5 | 22 | 11 | D5 | NS | NS | F5 | NS | NS | H5 | NS | NS |
| | B6 | 19 | 0 | D7 | NS | NS | F6 | NS | NS | H6 | NS | NS |
| | B7 | 15 | 0 | D8 | 31 | NS | F7 | NS | NS | H7 | NS | NS |
| | B8 | 5 | NA | D9 | NS | NS | | | | H8 | NS | NS |
| | B9 | 8 | 5 | | | | | | | | | |
| | B10 | 0 | 11 | | | | | | | | | |

Figure 4:
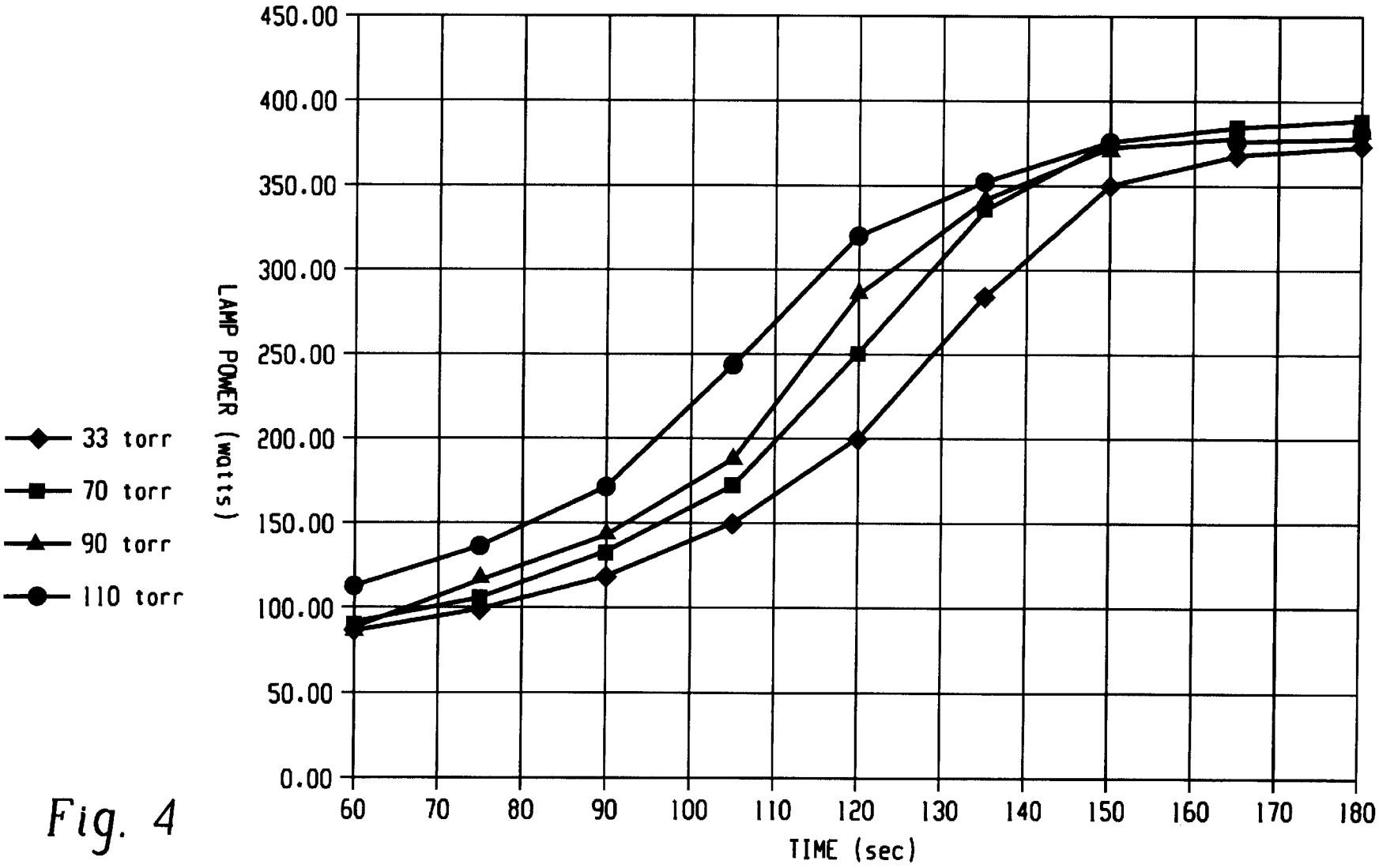
FIG. 4 is a graphical representation of examples evaluating the starting ability of the subject invention.

The lamps of the type corresponding to cells A, C, E and G were also evaluated for lamp power versus time. This reflects the "warm up" time associated with a particularly MHL reaching its desired operating power, in this instance about 400 watts. Reference to FIG. 4 portrays the results of these evaluations.

In addition, the present invention is believed to reduce the CTT (coil to tip transition time) for lamps, thereby reducing the tungsten evaporation to the walls of the discharge tube. In MHL, the work function reducing agent is on the tip of the electrode. But, during initial start up, the arc-terminus is on the coil of the electrode, whose work function is higher than that of the tip of the electrode. Thus, for larger CTT's the local temperature of the arc on the coil is much higher, thereby increasing the tungsten evaporation rate. As evidenced by the following evaluation the present invention has demonstrated its functionality in reducing CTT.

The results of the CTT evaluations (in seconds) are shown in Table II:

TABLE II

| lamp | 33 torr top | 110 torr top | 33 torr bottom | 110 torr bottom |
|---|---|---|---|---|
| 1 | 67 | 50 | 72 | 65 |
| 2 | 68 | 40 | 92 | 62 |
| 3 | 62 | 40 | 105 | 58 |
| 4 | 68 | 47 | 63 | 54 |
| 5 | 62 | 50 | 112 | 80 |
| 6 | 86 | 43 | 118 | 52 |
| 7 | 75 | 56 | 80 | 65 |
| 8 | 76 | 34 | 90 | 48 |
| 9 | 75 | 82 | 115 | 86 |
| avg | 71.0 | 49.1 | 94.1 | 63.3 |

The results show that higher argon pressure MHL's fitted with a voltage doubler function adequately in a starting mode.

Figure 6:
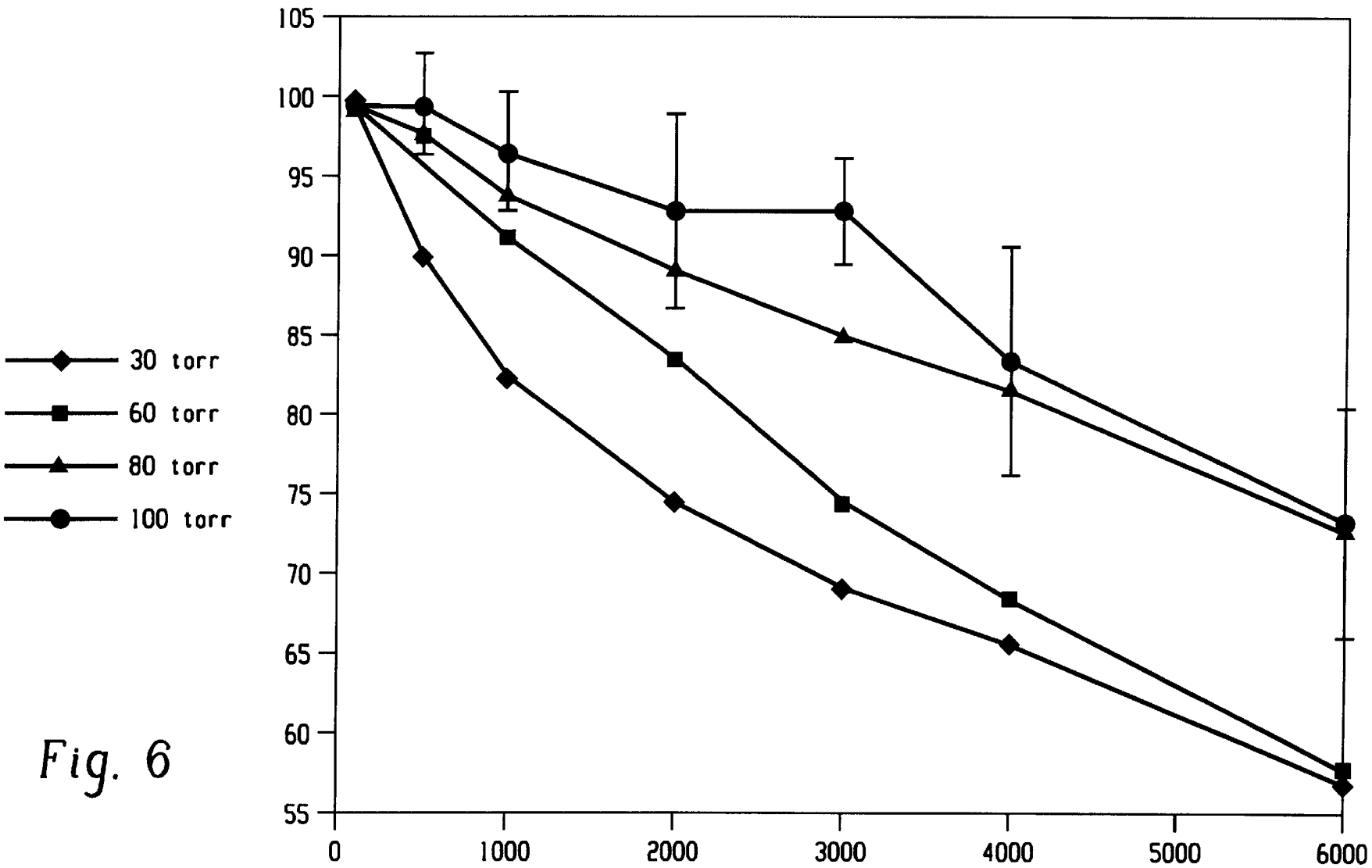
FIG. 6 is a graphical representation of examples evaluating the effect of argon fill pressure on lumen maintenance.

Lumen Maintenance 250 watt standard metal halide (scandium and sodium iodide plus mercury) lamps of the general type shown in FIG. 1 were constructed and evaluated at a variety of argon pressures. However, the lamps did not include the starting circuit/electrode or a voltage doubling circuit, but instead were lit using an external ignitor. The life tests demonstrate the effect of cold fill gas on lumen maintenance. Referring now to FIG. 6, it can be seen that an increased cold fill improved lumen maintenance at all levels, but was particularly effective at 80 and 100 torr levels at 6000 hours.

Thus, it is apparent that there has been provided, in accordance with the invention, a metal halide lamp that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appending claims.

We claim:

1. A metal halide lamp comprising an arc tube containing an ionizable medium and having electrodes sealed into opposed ends of the arc tube, the ionizable medium including mercury, a metal halide, and an inert gas selected from the group consisting of argon, krypton, and xenon and mixtures thereof, said inert gas having a cold pressure of at least 50 torr and a starting circuit having an open circuit voltage of at least 200 volts RMS.

2. The lamp of claim 1 wherein said inert gas is at a cold pressure greater than 70 torr.

3. The lamp of claim 1 wherein said inert gas is at a cold pressure greater than 110 torr.

4. The lamp of claim 1 wherein said inert fill gas is substantially argon.

5. The lamp of claim 1 having a power greater than or equal to about 400 watts.

6. The lamp of claim 1 wherein said electrode is comprised of tungsten.

7. A metal halide lamp comprising a vitreous arc tube containing a starting electrode, an ionizable medium and having tungsten electrodes sealed into opposed ends of the arc tube, an outer envelope enclosing the arc tube and including one end accommodating inleads sealed therethrough, a base attached to the outer envelope having input terminals, the input terminals being connected to the inleads which in turn are connected to the tungsten electrodes, a mount supporting the arc tube within the outer envelope, the ionizable medium including mercury, a metal halide, and an inert gas selected from the group consisting of argon, krypton, and xenon and mixtures thereof, and a starting circuit having an open circuit voltage of at least 200 volts RMS and wherein the inert gas has a pressure of at least about 70 torr.

8. The lamp of claim 7 wherein said starting circuit is a voltage doubling circuit comprising a diode and a capacitor connected in series across said input terminals and having their junction connected to the mount and a connection between said junction and said starter electrode serving to apply a positive bias thereto to facilitate starting.

9. The lamp of claim 7 wherein said starting circuit includes a diode and first and second resistors, the diode and the first resistor connected in series and bridged between one of said tungsten electrodes and said starter electrode, and said second resistor being in series with said further tungsten electrode and bridged between said starter electrode and the lead in wire for said starting electrode.

10. The lamp of claim 7 wherein said starting circuit comprises a diode and first and second resistors, the diode and the first resistor being connected in series and bridged across the tungsten electrodes, and the second resistor being connected between the starter electrode and the remote tungsten electrode.

11. The lamp of claim 7 wherein said starting circuit comprises a pair of starting probes, each disposed within the arc tube adjacent the respective one of said tungsten electrodes, and energizable for establishing ionization between it and its respective tungsten electrodes thereto, biasing means receptive of a lamp voltage applied in use to the lamp for biasing said tungsten electrodes and said starting probes, said biasing means comprising means for alternatively biasing each tungsten electrode negative relative to its respective starting probe during alternative half cycles of the voltage applied to the lamp.

12. The lamp of claim 8, including a heat shield to protect the diode.

13. The lamp of claim 9, including a heat shield to protect the diode.

14. The lamp of claim 10, including a heat shield to protect the diode.

15. The lamp of claim 9 including a bimetallic switch between said diode and said one of the resistors to switch the starting circuit out of a main circuit at a selected temperature.

16. The lamp of claim 9 wherein said first resistor has a resistance less than said second resistor.

17. The lamp of claim 16 wherein said first resistor has a resistance five times less than said second resistor.

18. The lamp of claim 9, having a power greater than or equal to about 400 watts and said first resistor has a resistance of 20 Kohms or less and said second resistor has a resistance of 40 Kohms or greater.

19. The lamp of claim 10 wherein said first resistor has a resistance less than said second resistor.

20. The lamp of claim 10 wherein said first resistor has a resistance five times less than said second resistor.

* * * * *